US005889475A

United States Patent [19]

Klosinski et al.

[11] Patent Number: 5,889,475

[45] Date of Patent: Mar. 30, 1999

[54] WARNING SYSTEM FOR EMERGENCY VEHICLES

[76] Inventors: Stefan Klosinski, 1908 Marlin Dr., Bellair Bluffs, Fla. 34646; Don Fuller, 2716 Capricorn Pl., Holiday, Fla. 34261

[21] Appl. No.: 825,133

[22] Filed: Mar. 19, 1997

[51] Int. Cl.[6] ..... G08G 1/00

[52] U.S. Cl. ..... 340/902; 340/906

[58] Field of Search ..... 340/901, 902, 340/904, 906

[56] References Cited

U.S. PATENT DOCUMENTS

| | | | |
|---|---|---|---|
| 3,662,328 | 5/1972 | Spivak | 340/903 |
| 3,997,868 | 12/1976 | Ribnick et al. | 340/902 |
| 4,443,790 | 4/1984 | Bishop | 340/902 |
| 4,625,206 | 11/1986 | Jensen | 340/902 |
| 4,764,978 | 8/1988 | Argo et al. | 340/902 |
| 4,806,931 | 2/1989 | Nelson | 340/902 |
| 5,303,259 | 4/1994 | Loveall | 340/902 |
| 5,345,232 | 9/1994 | Robertson | 340/902 |
| 5,428,544 | 6/1995 | Shyu | 340/902 |
| 5,539,398 | 7/1996 | Hall et al. | 340/906 |
| 5,635,921 | 6/1997 | Maxwell et al. | 340/902 |

*Primary Examiner*—Brent A. Swarthout

[57] ABSTRACT

A system for warning of an approaching emergency vehicle comprising of a transmitter, a receiver, an audio and visual indicator. The transmitter transmitting a broad ban of AM and FM frequencies that are broadcasted of a short range to audible warn vehicles and pedestrian through existing radios of an approaching emergency vehicle. The transmitter also sending a signal to the receiver having circuitry to activate and deactivate audible and visual warning indicators of an approaching emergency vehicle. The audible and visual indicators are normally affixed to typical traffic signal located at street intersections.

3 Claims, 5 Drawing Sheets

WARNING SYSTEM FOR EMERGENCY VEHICLES

BACKGROUND

1. Field of the Invention

Generally, this invention is directed towards warning common vehicles, pedestrians near traffic signals, and people near radios of approaching emergency vehicles. More specifically, this invention uses a radio signal transmitter that activates a special radio receiver affixed near traffic signals to audibly and visually warn vehicles in close proximity to the traffic signals of an approaching emergency vehicle. Additionally, a radio signal transmitter is also adapted to the emergency vehicle to broadcast an emergency siren signal over radio receivers in close proximity to the emergency vehicle.

Time is usually a critical factor during emergency situations involving accident victims, people needing medical treatment after being involved in some sort of accident. Accident victims needing emergency treatment are forced to wait for an ambulance to arrive at the seen of an accident and transport the patient to a hospital for proper treatment. There are many case every day where patients die on the way to hospitals due delays in the time it takes an emergency vehicle to arrive at the accident scene and transport a patient to the hospital. If the time it takes for an emergency vehicle to arrive at an accident scene and transport accident victims to a hospital for treatment can be reduced, many more lives each year could be saved.

Many times the emergency vehicles are slowed down at street intersections because of other vehicles are not being aware of approaching emergency vehicles and not staying clear of the intersection. This causes the emergency vehicles to slow down and delay the emergency reaction times of the emergency vehicles.

Another problem noticed for emergency vehicles are the passengers of vehicle not being aware of approaching emergency vehicles due to the radio volume being turned up too high on their radio head phones or in the interior space of their vehicle. This scenario has been accused of causing many accidents to occur involving emergency vehicles with non-emergency vehicles.

2. Description of the Prior Art

Several approaches have been provided for the warning of approaching emergency vehicles, in U.S. Pat. No. 5,235,329, "A combination to detect the proximity of an emergency vehicle including a transmitter in the emergency vehicle and a receiver in another vehicle, the receiver actuating an alarm such as a blinking light upon the reception of a transmission from an emergency vehicle."

In U.S. Pat. No. 5,187,373, "An optical signal emitter assembly emits light pulses which are received by an optical traffic preemption system detector. The optical signal emitter assembly employs a honeycomb element positioned in front of a light source which collimates light emitted by the optical signal emitter assembly. The optical signal emitter assembly is convertible from a stand-alone unit containing power supply circuity, timing circuitry, and a light source in a single housing, to a unit wherein the light source can be mounted independently from a housing containing the power supply circuitry and the timing circuitry."

In the art taught by U.S. Pat. No. 4,896,153, a "System to control and temporally adapt semaphoric regulating, consisting of one first receiving radioelectric equipment (F), equipped with nondirectional aerial, and provided, on roads, buildings, etc., in number suitable for requirement of monitored crossings, to receive and decode signals on a given frequency; one transmitting radioelectric equipment (I), equipped with directional aerial (L), in the same number as that of said receiving radioelectric equipments, suitable for retransmitting said properly reencoded signals, said receiving and transmitting equipment forming decentralized monitoring sites (4) for controls and transit; one second receiving radioelectric equipment (5), 3 with nondirectional aerial (M), provided near the usual switching exchange (7) of semaphoric signals (3), able to decode the signal received on a given frequency; and of one main transmitter (2), connected to aerial means (D), and provided on rescue vehicle (1); between said second receiving radioelectric equipment and usual switching exchange being provided an intelligent interface (6)."

While some of the prior art may contain some similarities relating to the present invention, none of them teach, suggest or include all of the advantages and unique features of a system of warning of an approaching emergency vehicle as the invention disclosed herein.

For the foregoing reasons, there is a need for a system that will warn pedestrians and vehicles particularly at intersections of approaching emergency vehicles such that many more lives can be saved, and the number of accidents between emergency vehicles, and non-emergency vehicles will be reduced.

SUMMARY

The present invention is directed warning vehicle and pedestrians listening to radios of an approaching emergency vehicle to take caution and allow the emergency vehicle to proceed through without being impeded by traffic. The system comprises generally of a transmitter affixed to an emergency vehicle, a receiver normally affixed to a traffic signal device, and audible and visual warning indicators.

Accordingly, it is an object of this invention to provide a transmitter that will transmit a broad band of AM and FM frequencies that will be broadcasted over existing radios at a given distance thereby warning of an approaching emergency vehicle.

Another object of this invention is to provide a modified traffic signal device having an additional audible and visual indicator to warn vehicles and pedestrians at street intersections of an approaching emergency vehicle.

Still another object of this invention is to provide a receiver having circuitry that activate and deactivate the audible and visual indicators.

Still yet a another object of this invention is to provide a receiver that will deactivate the audible and visual indicators when an emergency vehicle is moving away from the receiver.

A further object of this invention is to provide a receiver that active the audible and visual indicators when an emergency vehicle is approaching the receiver.

Another object of this invention is to provide a receiver that changes the traffic signal from red to green prior to the arrival of the approaching vehicle and in the same lane as the emergency vehicle.

Still another object of this invention is to provide a global satellite position device in the emergency vehicle to give the location and direction of the emergency vehicle. This will enable a central computer station to activate the signal from red to green for allowing emergency vehicles to proceed as rapidly as possible.

A further object of this invention is to provide a computer system working with the global satellite positioning device to enable a route to be pre-determined for the emergency vehicle to get to the accident scene, and turn the traffic signal from red to green along this predetermined path.

Other objects and a fuller understanding of the invention will become apparent from reading the following detailed description of a preferred embodiment in conjunction with the accompanying drawings.

BRIEF DESCRIPTION OF THE DRAWINGS

This invention, together with other objects, features, aspects and advantages thereof, will be more clearly understood from the following description, considered in conjunction with the accompanying drawings.

Five sheets of drawings are furnished, sheet one contains FIG. 1, sheet two contains FIG. 2, sheet three contains FIG. 3, sheet four contains FIG. 4, and sheet five contains FIG. 5.

DESCRIPTION OF THE PREFERRED EMBODIMENTS

Figure 1:
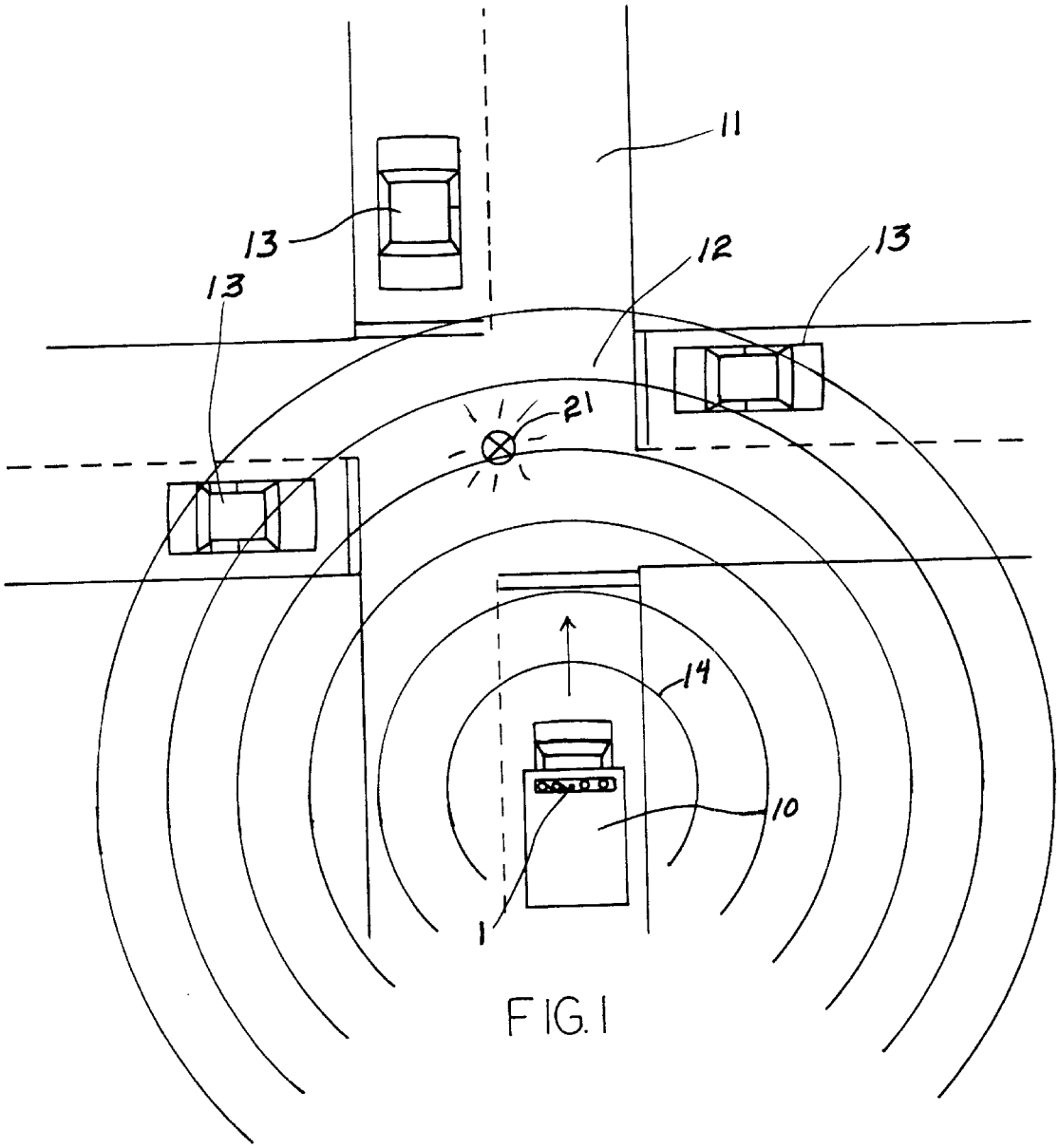
FIG. 1 is a top view of an intersections having an emergency vehicle approaching the intersection while activating an audible and visual indicator.

Referring now to FIG. 1, a system for warning of an approaching emergency vehicle 10, and in this particular scenario, at an intersection 12. The system comprising generally of a transmitter 1 transmitting radio signals to a traffic signal receiver 2, and an audio and visual indicator 8 and 9 respectively.

The traffic signal device 21 in FIG. 1 is shown in the activated state warning approaching vehicles of the approaching emergency vehicle 10. The transmitter 1 will be able to transmit radio waves 14, or other forms of electromagnetic radiation to activate the receiver 2 that an emergency vehicle 10 is approaching. The receiver 2 will have a circuitry that will be activated and deactivated using the doppler affect or frequency shift of the approaching emergency vehicle 10. Also, the transmitter 1 will transmit a broad band of AM and FM frequencies 22 whose signal will override the existing AM and FM radio waves in the air for a short distance thereby transmitting a siren signal through the speakers of a typical radio receiver 3 in a non-emergency vehicle 13. This will warn the passengers of vehicles 13 that previously were unable to hear of an approaching emergency vehicle 10 due to the radio volume turned too high that an emergency vehicle 10 is approaching and that they should take caution. It will also warn pedestrians or bicyclist wearing radio headphones of an approaching emergency vehicle 10 if the radio receiver 3 is turned on and not a tape deck, CD player or accessory.

Another feature of the present system, the signal strength of the transmitter 1 will be dependent of the speed of the emergency vehicle 10. As the speed of the emergency vehicle 10 increases, the signal strength will increase respectively, thus activating the traffic signal receiver and radio receivers a greater distance ahead. Or the doppler effect will be increased thereby giving an observed higher frequency that is detected by the detector and the warning indicator is thus activated sooner than normal.

Figure 2:
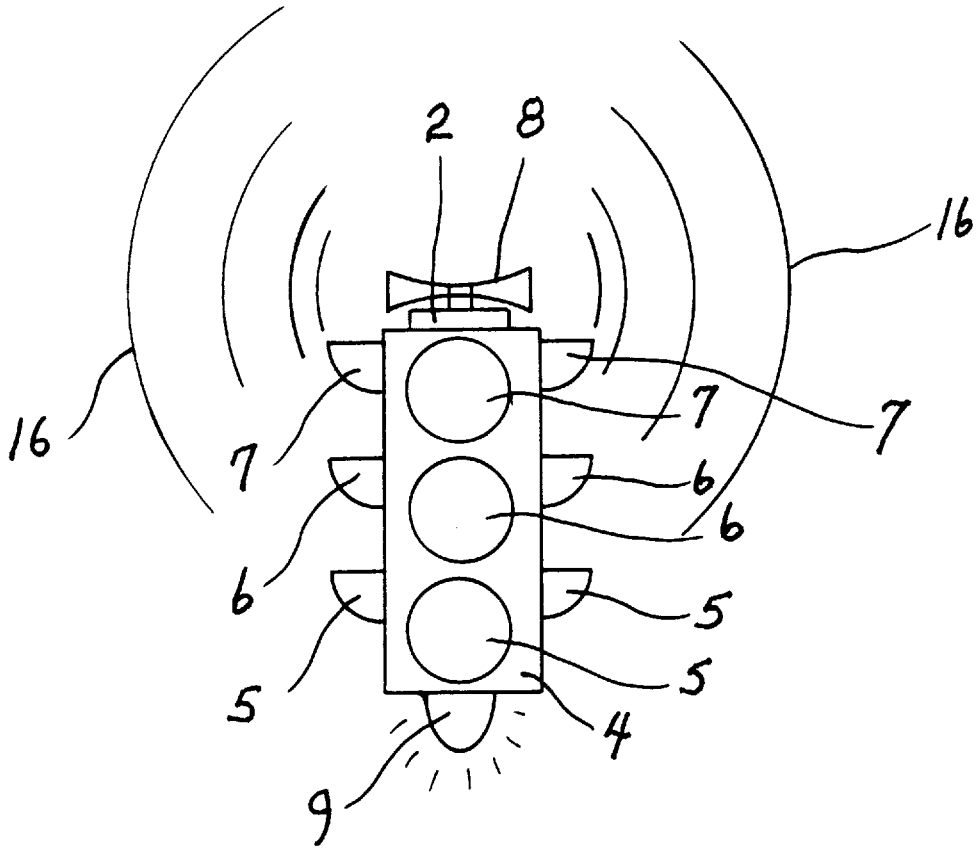
FIG. 2 shows a side view of a traffic signal device having an extra audible and visual indicator for warning of an approaching emergency vehicle.

Referring now to FIG. 2, we see a modified traffic signal indicator 4 having a red light 7, yellow light 6, and green light 5 as well as an audible warning indicator 8, and a visual warning indicator 9 affixed thereon. The specific positioning of these indicators in the Figure is not important, just that the visual and audible indicator are able to be seen and heard respectively. In the figure, the audible warning indicator 8 is shown giving off an audible signal 16 to warn pedestrians and vehicles 13 of the approaching emergency vehicle 10. The audible and visual indicators 8 and 9 could possibly be eliminated whereupon the receiver 2 will have circuitry that will cause all of the lights of the traffic signal device 4 to flash red thereby causing all traffic to stop at the intersection 12.

Figure 3:
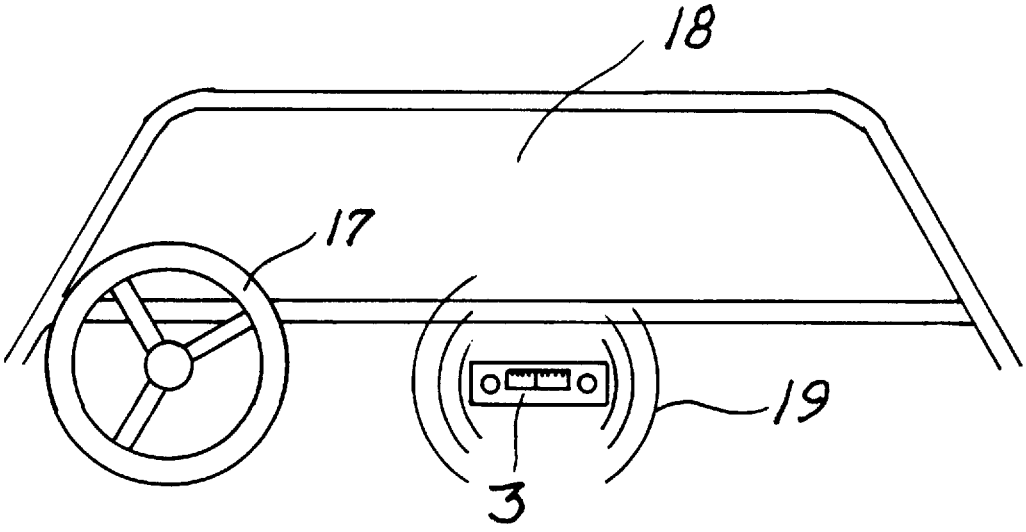
FIG. 3 shows a dashboard of a non-emergency vehicle with the radio receiver of the vehicle audibly signalling the passengers of an approaching emergency vehicle.

In FIG. 3, we see the inside dashboard of a typical non-emergency vehicle 13 having a steering wheel 17, a windshield 18, and a radio receiver 3. The radio receiver is playing a siren signal 19 over the speakers thereby warning the passenger of an approaching emergency vehicle 10. The radio receiver 3 needs to be turned on and tuned into the AM or FM frequencies to work. It will not work if accessory components are in operation such as tape and CD players.

Figure 4:
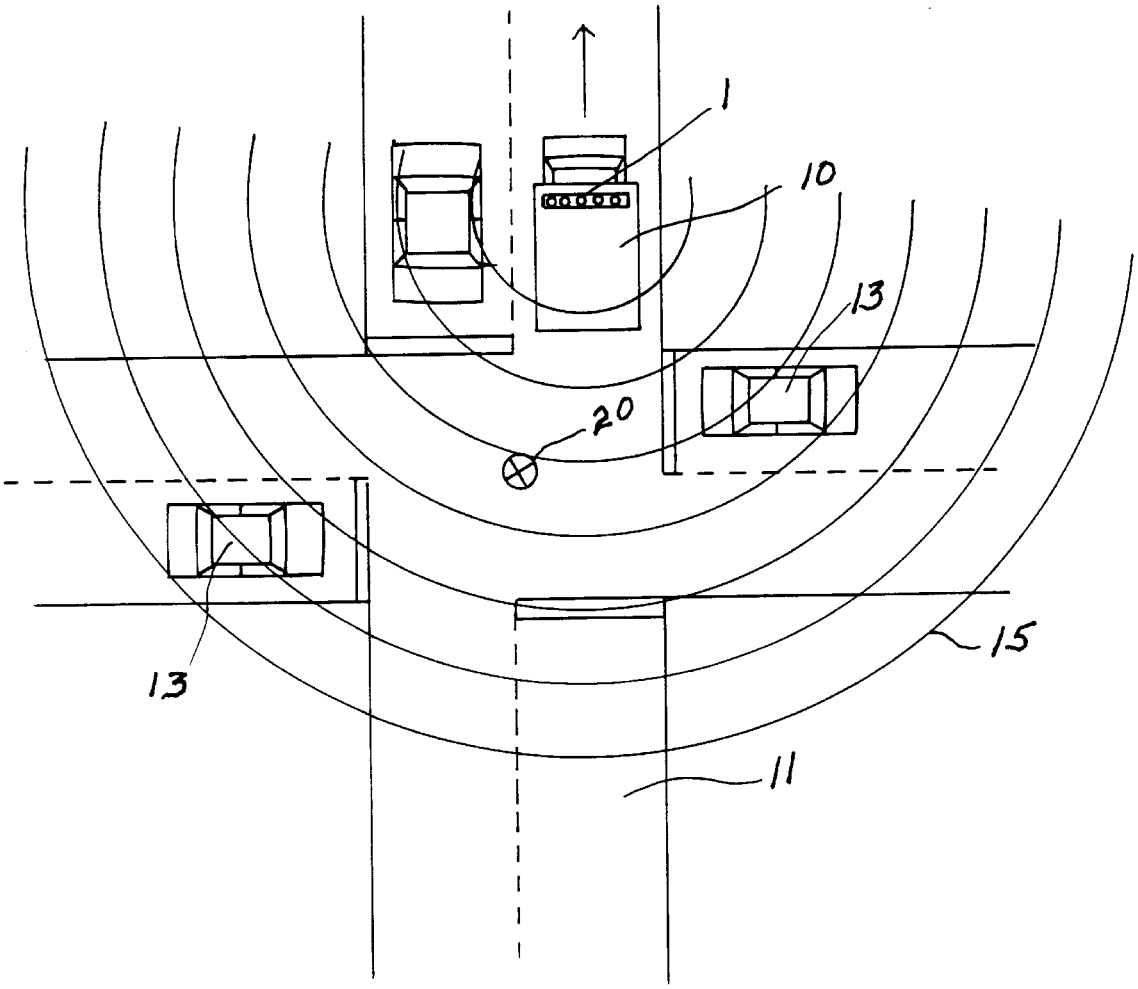
FIG. 4 shows a top view of an intersections having an emergency vehicle leaving the intersection while deactivating the audible and visual indicator.

In FIG. 4, we see a top view of the system with an emergency vehicle 10 traveling down a street 11 already having passed an intersection 12. The observed frequency 15 now observed by the receiver 2 is now lower than the approaching frequency 14 thereby the internal circuitry of the receiver 2 now turns off the audio and visual indicators 8 and 9. The traffic signal 20 is shown in an off state thereby allowing traffic to resume normally.

Figure 5:
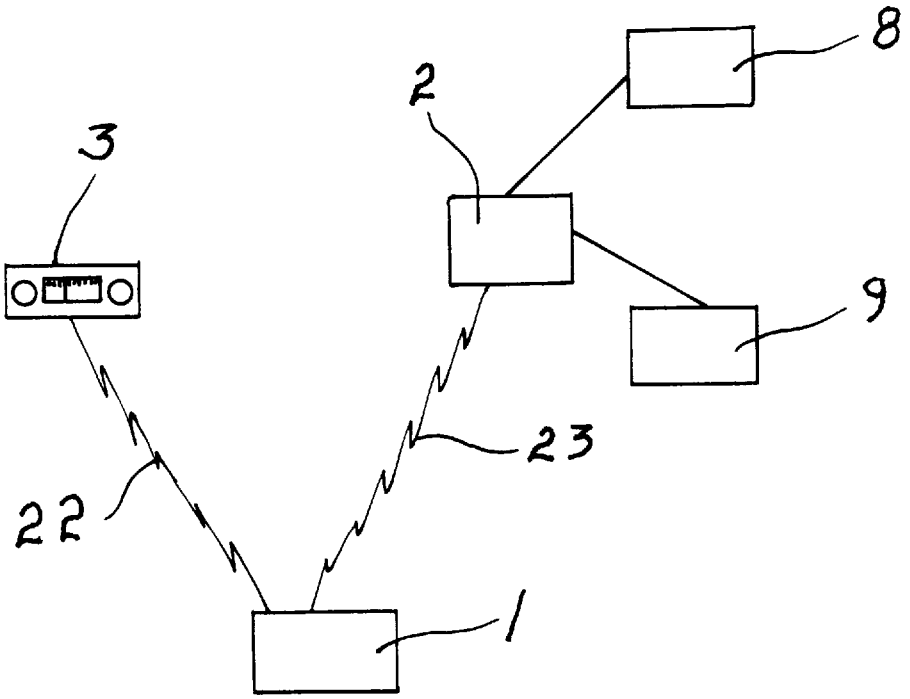
FIG. 5 shows a block diagram of the major components used in the system for warning non-emergency vehicles of an approaching emergency vehicle.

In FIG. 5, we see a block diagram of the typical components used in the emergency vehicle warning system. A transmitter 1 transmitting a broad band of AM and FM signals 22 to all radios in close proximity to the transmitter 1. The transmitter 1 also transmitting a specific radio frequency signal 23 to a receiver 2. The receiver 2 observes whether the transmitted signal 23 is of a higher or lower frequency than the set frequency of the transmitter 1. If the frequency is higher, then the receiver 2 determines that the emergency vehicle 10 is approaching the receiver 2 and thus turns on the audio and visual indicators 8 and 9. If the observed frequency is lower 15, then the receiver 2 determines that the emergency vehicle 10 is moving away from the receiver 2 and turns off the audio and visual indicators 8 and 9 to allow normal operation of the traffic signal device 4.

In carrying out this invention in the illustrative embodiment thereof, a passenger of an emergency vehicle 10 activates the emergency siren which automatically activates the signal transmitter 1. The transmitter 1 then broadcast the full spectrum AM and FM radio frequencies 22 which are broadcasted over radios 3 over a given distance of approximately one hundred yards. An additional signal 23 is sent out which activates the audio and visual indicators 8 and 9 normally affixed to existing traffic signal devices 4. When the emergency vehicle 10 approaches the traffic signal 4, the observed frequency 14 is higher than the transmitted frequency 23 thus triggering the receiver 2 to activate the audio and visual indicators 8 and 9 to turn on. Once the emergency vehicle 10 passes the receiver 2, or moves away from the receiver 2, the observed frequency 15 is lower than the transmitted frequency 23 thereby turning off the audio and visual indicators 8 and 9. In addition, when the speed of the emergency vehicle 10 increases, the signal strength of the transmitter 1 is increased thereby triggering the receiver 2 a greater distance ahead prior to the arrival of the emergency vehicle 10. When the emergency vehicle 10 turns off the emergency lights, the transmitter 1 is automatically turned off as well.

Accordingly, a very unique, attractive, and convenient system is provided for warning non-emergency vehicle 13, pedestrians at intersection 12, and people listening to radios 3 of approaching emergency vehicle 10 prior to their arrival.

Since minor changes and modifications varied to fit particular operating requirements and environments will be understood by those skilled in the art, the invention is not considered limited to the specific examples chosen for purposes of illustration, and includes all changes and modifications which do not constitute a departure from the true spirit and scope of this invention as claimed in the following claims and reasonable equivalents to the claimed elements.

What is claimed is:

1. A system for warning of an approaching emergency vehicle, said system comprising:

(a) a transmitter transmitting a specific electromagnetic frequency signal, (b) a receiver observing said signal, said receiver determining if said signal is higher or lower than a set specific frequency signal, said receiver activating a visual and audio indicator if said signal has a higher frequency than said set frequency signal, said reciiver deactivating said indicator if said signal is lower than said set frequency signal, whereby said indicator warns of an approaching emergency vehicle, (c) a means for modulating an amplitude of said transmitter, said modulating means dependent upon said speed of said vehicle, said transmitter emitting in the AM FM bandwidth, said amplitude of said transmitter increasing in amplitude when said speed of said vehicle increases, (d) a positioning device for giving the location, speed and direction of said emergency vehicle, (e) a means for determining the quickest route to a emergency scene, and (f) a means for changing all traffic signals from red to green along said quickest route at specific time periods depending upon said location, speed, and direction of said emergency vehicle, (g) a means for activating said indicator to an on and off position when said emergency vehicle is approaching and leaving a reception region for a transmitted signal, respectively, whereby said signals are all green prior to the arrival of said emergency vehicle thereby allowing said emergency vehicle to get to said emergency scene as quickly as possible.

2. A system for warning of an approaching emergency vehicle, as set forth in claim 1 wherein said electromagnetic frequency is in the micro wave range.

3. A system for warning of an approaching emergency vehicle, as set forth in claim 1 wherein said electromagnetic frequency is coherent.

* * * * *